US008360830B2

(12) United States Patent
Klug

(10) Patent No.: US 8,360,830 B2
(45) Date of Patent: Jan. 29, 2013

(54) GRINDING LAMELLA AND GRINDING WHEEL HOLDING SAME

(75) Inventor: Georg Klug, Lindlar (DE)

(73) Assignee: Lukas-Erzett Vereinigte Schleif-und Fräswerkzeugfabriken GmbH & Co. KG, Engelskirchen (DE)

( * ) Notice: Subject to any disclaimer, the term of this patent is extended or adjusted under 35 U.S.C. 154(b) by 1152 days.

(21) Appl. No.: 12/224,703

(22) PCT Filed: Feb. 28, 2007

(86) PCT No.: PCT/EP2007/001715

§ 371 (c)(1),
(2), (4) Date: Sep. 3, 2008

(87) PCT Pub. No.: WO2007/101589

PCT Pub. Date: Sep. 13, 2007

(65) Prior Publication Data

US 2009/0068938 A1 Mar. 12, 2009

(30) Foreign Application Priority Data

Mar. 3, 2006 (DE) ..... 10 2006 010 366

(51) Int. Cl.
*B24B 19/00* (2006.01)

(52) U.S. Cl. ..... 451/529; 451/542; 451/543

(58) Field of Classification Search ..... 451/526, 451/527, 529, 533, 534, 537, 542, 543
See application file for complete search history.

(56) References Cited

U.S. PATENT DOCUMENTS

| | | | | | |
|---|---|---|---|---|---|
| 269,688 | A | * | 12/1882 | Levett | 15/230.14 |
| 1,697,442 | A | * | 1/1929 | Webber | 451/537 |
| 2,043,189 | A | | 6/1936 | Zimmerman | |
| 3,144,739 | A | * | 8/1964 | Brutvan et al. | 451/543 |
| 3,385,010 | A | | 5/1968 | Vorce et al. | |
| 3,417,420 | A | * | 12/1968 | Rock | 15/230.16 |
| 3,460,293 | A | * | 8/1969 | Sweet | 451/242 |
| 3,793,783 | A | * | 2/1974 | Paterno et al. | 451/543 |

(Continued)

FOREIGN PATENT DOCUMENTS

| | | |
|---|---|---|
| CN | 1486232 | 3/2004 |
| DE | 1652912 | 4/1971 |

(Continued)

*Primary Examiner* — Timothy V Eley
(74) *Attorney, Agent, or Firm* — Harness, Dickey & Pierce, P.L.C.

(57) ABSTRACT

A grinding lamella (1) for being arranged on a rotatingly drivable grinding wheel (8), has at least two annular portions (4, 5, 6, 7, 24, 25, 26, 27, 34, 35, 36, 37, 44, 45, 46, 47) arranged at an angle (α) relative to one another. At least partially, the grinding lamellae (1) have a shape that deviates from the shape of a circular wheel with a central aperture. The grinding wheel (8) containing the grinding lamellae has at least one carrier element (2) and a least two such grinding lamellae (1) that partially overlap and, together, form an annular shape. If use is made of a pattern (14, 32) for a piece of material or a strip of material for producing the grinding lamellae (1), the grinding lamellae (1) are arranged side by side in the same direction so as to adjoin one another and offset relative to one another by 180°.

23 Claims, 8 Drawing Sheets

U.S. PATENT DOCUMENTS

| | | | | |
|---|---|---|---|---|
| 5,142,829 | A * | 9/1992 | Germain | 451/537 |
| 5,183,479 | A * | 2/1993 | Grimes | 51/293 |
| 5,405,286 | A * | 4/1995 | Welsch | 451/527 |
| 5,406,929 | A * | 4/1995 | Udert et al. | 125/15 |
| 5,643,068 | A | 7/1997 | Ward, Sr. | |
| 6,007,415 | A | 12/1999 | Van Osenbruggen et al. | |
| 6,368,187 | B2 * | 4/2002 | Wentworth et al. | 451/28 |
| 6,582,289 | B1 * | 6/2003 | Eisenberg | 451/548 |
| 6,595,842 | B2 * | 7/2003 | Misiura | 451/528 |
| 7,004,829 | B2 | 2/2006 | Keuler et al. | |
| D518,721 | S * | 4/2006 | Wahl et al. | D9/457 |
| D582,445 | S * | 12/2008 | Yanase | D15/126 |
| 2004/0009744 | A1 | 1/2004 | Conley et al. | |

FOREIGN PATENT DOCUMENTS

| | | | |
|---|---|---|---|
| DE | 4031454 | A1 | 4/1992 |
| DE | 9205471.4 | U1 | 7/1992 |
| DE | 4430229 | A1 | 2/1996 |
| DE | 29802791 | U1 | 5/1998 |
| DE | 20214389 | U1 | 12/2002 |
| DE | 20 2004 004 027 | U1 | 9/2005 |
| EP | 1 142 673 | A2 | 10/2001 |
| EP | 1400312 | B1 | 3/2004 |
| GB | 2 298 154 | A | 8/1996 |
| WO | WO-99/16583 | | 4/1999 |
| WO | WO-00/35634 | | 6/2000 |

* cited by examiner

GRINDING LAMELLA AND GRINDING WHEEL HOLDING SAME

CROSS-REFERENCE TO RELATED APPLICATION

This application is a national phase of International Application No. PCT/EP2007/001715, filed Feb. 28, 2007 which claims priority to German Patent Application No. 102006010366.1, filed Mar. 3, 2006, which application is herein expressly incorporated by reference.

FIELD

The disclosure relates to a grinding lamella and, more particularly, to a grinding lamella for a rotatingly drivable grinding wheel, as well as to a grinding wheel with at least one carrier element. At least two such grinding lamellae partially overlap one another and together form an annular shape.

BACKGROUND

Such grinding wheels provided with a number of grinding lamellae are placed onto a driving machine in order to be able to machine workpiece surfaces by grinding. Such state of the art grinding wheels and grinding lamellae are known in a number of different embodiments.

EP 1 142 673 B1 for example discloses grinding lamellae that include two parallel edges and, between them, one convex and one concave third and fourth edge. The grinding lamellae are arranged to overlap, roof-tile-like, on an annular carrier portion of a carrier.

Furthermore, it is known from DE 20 2004 004 027 U1 to provide a flap-type grinding wheel with a wheel- or plate-shaped carrier. Grinding lamellae that overlap roof-tile-like are arranged on the carrier in a bed of glue. At the circumference of the grinding wheel, recesses are cut out that are approximately trapezoidal in shape or which have the shape of a part of a circular ring. The rear edge of the recesses—if viewed in the direction of rotation of the grinding wheel—extends approximately radially. The recesses serve to constantly monitor the grinding results and to reduce workpiece heating. Further, grinding wheels with recesses are also known from DE 202 14 389 U1, U.S. Pat. No. 6,077,415 as well as from DE 1 652 912, DE 298 02 791 U1, and WO 00/35634. The three latter publications disclose grinding wheels with a grinding material applied to a carrier material without grinding lamellae. Further grinding wheels with a circular circumference, and grinding lamellae but without visual recesses are known for example from DE 92 05 471 U1, DE 40 31 454, DE 44 30 229 and WO 9916583.

Grinding wheels with or without visual recesses and grinding lamellae according to the state of the art include complicated designs because, as a result of a large number of grinding lamellae, the production of the grinding wheels is complicated and cost-intensive.

SUMMARY

It is an object of the present disclosure to provide grinding lamellae and grinding wheels that can be produced cost-effectively by ensuring a small amount of waste, using patterns, wherein it is possible to monitor the grinding results during the grinding operation, with the grinding wheels having a long service life.

In accordance with the disclosure, a grinding lamella, more particularly for being arranged on a rotatingly drivable driving wheel, includes at least two annular portions that are arranged at an angle relative to one another. The annular portions have a shape that at least partially deviates from the shape of a circular lamellae with a central aperture. For a grinding wheel, it comprises at least one carrier element and at least two such grinding lamellae that partially overlap one another and which, together, form an annular shape. A pattern for cutting a piece of material or a strip of material for producing such grinding lamellae is achieved. The grinding lamellae are arranged side by side so as to adjoin one another in the same direction as well as being offset by 180° and adjoin one another.

A grinding lamella is provided that is not simply oblong and rectangular as in the state of the art, but comprises a plurality of portions that are arranged at an angle relative to one another, so that already part of a ring is delimited by merely one lamella. The ring includes grinding material formed by arranging a plurality of grinding lamellae in a way so that they are offset relative to one other and arranged one above the other. Thus, the design no longer provides small-format platelets in the form of roof-tile-like overlapping lamellae, as is the case in the state of the art. The design provides larger-format, angled lamellae. The lamellae are arranged to partially overlap one another. In a preferred embodiment, the grinding lamellae are connected to a carrier element in the region of at least one annular portion and along inner edges. One or several annular portions remain free for grinding purposes. Furthermore, by staggering the angular grinding lamellae, not only is a larger surface provided for fixing each grinding lamella on the carrier element, but also there is a larger surface available for the grinding process. Thus, the individual grinding lamella is not only attached more securely on the grinding wheel, but also there is a larger effective grinding face available without any steps, that would otherwise have resulted in the small-format lamellae according to the state of the art.

When providing six grinding lamellae for example, each with at least three annular portions, more particularly four annular portions, they can be arranged to partially overlap one another. Additionally, they can be offset relative to one another by one annular portion and be positioned one above the other, with the outer edges of the annular portions positioned one above the other. They can cover each other and jointly form an outer circumferential edge of the grinding wheel.

Furthermore, it is possible to use a flat design for the grinding wheel because as a result of the larger dimensions of the individual grinding lamellae as compared to those of the state of the art, even a few grinding lamellae arranged one above the other are sufficient to form the ring at the grinding lamellae that is required for grinding purposes. For example, it is possible to provide six grinding lamellae offset relative to one another with each comprising annular portions that are offset relative to one another by approximately 60°. Each grinding lamella preferably comprises four such offset annular portions. Thus, in spite of the small number of grinding lamellae, a long service life of the grinding wheel is achieved due to the multi-layer nature of the grinding wheel in the edge region of the grinding wheel. The edge region is used for the grinding operation.

When using such grinding lamellae with annular portions offset relative to one another by an angle of 60°, a pattern for the approximately u-shaped grinding lamellae can save a great deal of space on a cut piece of material or length of material. There is very little waste when producing the grinding lamellae. According to a preferred embodiment, the annular portions are provided either with a pattern that repeats itself or they correspond to one another and/or are mirror-images relative to one another. Thus, the free arms (first and fourth annular portion) of the grinding lamellae composed of four annular portions are able to engage one another. More particularly, the free arms, the first and fourth annular portions, can be arranged side by side. A second row of u-shaped grinding lamellae are arranged side by side and can be arranged to be offset by 180° relative to the first row. The second and third annular portions of the grinding lamellae of adjoining rows contact one another. In the case of a third row, they are rotated by 180° with the first and the last (fourth) annular portions of the adjoining rows positioned side by side. Thus, first and last annular portions of the adjoining grinding lamellae are positioned between the first and last annular portion of a grinding lamella of the adjoining row. This is advantageous in that it is possible to save costs because of the small amount of material waste.

The annular portions may be approximately the same shape. Thus, in a simple way, reduces material waste even further because the repeating shapes of the individual grinding lamellae can very easily correspond to, and engage, one another. Alternatively, it is also possible for at least one of the annular portions to have a shape that deviates from that of the remaining annular portions. More particularly, the annular portions, relative to one another, with reference to a radially extending central axis, can include different widths in the radial direction of the grinding lamella. In a particularly preferred embodiment, the first annular portion has the greatest width and the last annular portion, the smallest width in the radial direction of the grinding lamella. As the grinding lamellae are normally arranged on a rotating grinding plate, the width in the radial direction means the width of the annular portions towards a fictitious center of the grinding lamellae positioned so as to form a ring.

If individual annular portions have a smaller width in the radial direction, it is possible, when layering the grinding lamellae for the purpose of completing a ring, that the grinding lamellae superimposed on one another are staggered towards the inside of the ring. The grinding lamellae are stepped in the radial direction in the inner region. Thus, it is possible to achieve an assembly where the outer edges of the grinding lamellae jointly form an outer circumferential edge of the grinding plate and the inner edges of the grinding lamellae are radially offset relative to one another. In the region of the inner edges, all the annular portions of the grinding lamellae include a surface region that is positioned directly opposite the carrier element. In this way, it is possible for the grinding lamellae to be glued along all their inner edges to the carrier element, so that they are securely held on the carrier element. Gluing between the individual grinding lamellae is thus avoided.

Furthermore, as a result, the material thickness decreases towards the center of the grinding wheel and increases outwardly towards the circumference of the grinding wheel. Thus, in the outer circumferential region of the grinding wheel, the material thickness is particularly great. During operation of a grinding tool, the highest speeds occur at the outer circumference. Most of the material is removed in the outer circumferential region of the grinding wheel. Thus, in the inner region of the grinding wheel less grinding material has to be made available. However, the service life of the grinding wheel is still advantageously long. If the first annular portion is provided with the greatest width in the radial direction and the last annular portion, more particularly the fourth portion, with the smallest width, the first annular portions of the grinding lamellae arranged side by side in the case of a grinding wheel can form the upper side of the grinding wheel and thus ensure a good covering towards the outside.

Because the annular portions have been given a shape that at least partially deviates from a circular lamella with a central aperture or because there is provided at least one annular portion of the grinding lamella, it is possible to provide a see-through region through which the grinding result can be monitored when the grinding wheel rotates. When only one circular lamella with a central aperture or a circular wheel with a central aperture is provided, a circular ring, a see-through region does not exist. In contrast to the state of the art, for example DE 20 2004 004 027 U1, the disclosure does not provide a see-through region in the form of segment-like recesses in the grinding lamella ring, but only in the circumferential edge region of the grinding lamellae. In principle, through-apertures through which it is possible to see can also be provided inside the surface of the grinding lamellae.

According to an advantageous embodiment, the outer circumferential edge of at least one annular portion of the grinding lamella can be curved to be concave and/or convex. In the region of the concave curvature, a see-through region can occur when the grinding lamella rotates. It goes without saying that alternative shapes are also possible where recesses are provided for see-through purposes. The recesses are in the form of regions projecting forwards or backwards along the outer circumferential edge of the grinding lamellae or of its annular portions.

In a plan view, the grinding wheel can be polygonal. The individual annular portions of the partially overlapping grinding wheels, in their region of transition from one annular portion to the next or within their shape include a corner so that a polygonal grinding wheel occurs. As a result, when the grinding wheel rotates, a transparent appearing see-through region for monitoring the grinding results can be created in the outer circumferential region. Furthermore, the grinding wheel, in a plan view, can include at least one rounded portion. As a result of the shape of the grinding wheel in the outer circumferential region, the respective see-through region can be varied. For example, the grinding wheel can also have at least one cut-out or recess along its outer circumferential edge and/or in at least one of its annular portions.

It is advantageous for the carrier element to be plate-shaped, with the ring of partially overlapping grinding lamellae arranged on the plate-shaped carrier element. In a preferred embodiment, the grinding lamellae are glued onto the carrier element, more particularly by a resin or epoxy resin. The plate-shaped carrier element can include metal, a resin-bonded glass fiber texture, a fiber material, a plastic material or a different firm, hard, tough, preferably non-splintering material. Material combinations are also possible. For instance, partially reinforcing the carrier element in the region around a central aperture to allow the engagement of a clamping-in journal of a driving machine to which the grinding wheel is secured. For example, the plate-shaped carrier element can consist of a vulcanised fiber. The carrier element can also be provided in the form of an annular grinding lamella with a central through-aperture for fixing the grinding wheel to a driving machine. The carrier element is preferably provided with the same circumferential edge shape as the ring consisting of layered partially overlapping grinding lamellae. To provide the connection with a driving machine, a through-aperture is provided preferably in the center of the carrier element, through which through-aperture there can be inserted a clamping journal of a grinding device for example, as already mentioned.

When producing the grinding lamellae, they can be punched out of a cut piece of material or a strip of material.

For the grinding lamellae, it is possible to provide a carrier material that is provided with a grinding material and comprises the required material strength.

Further areas of applicability will become apparent from the description provided herein. The description and specific examples in this summary are intended for purposes of illustration only and are not intended to limit the scope of the present disclosure.

DRAWINGS

To explain the disclosure further, embodiments of same will be described with reference to the drawings wherein.

DETAILED DESCRIPTION

Figure 1:
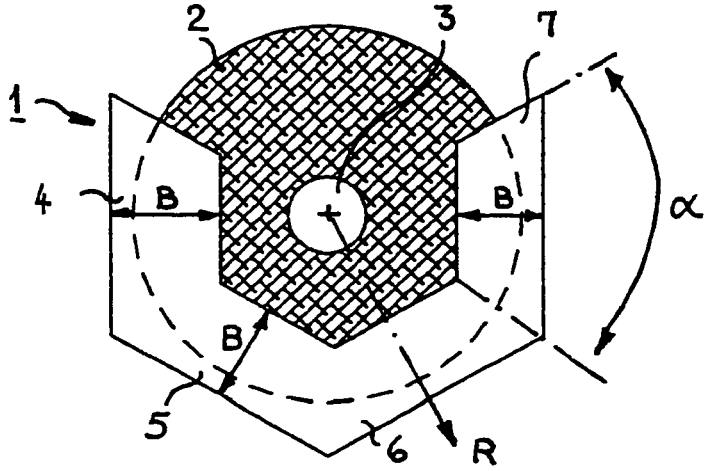
FIG. 1 is a plan view of a first embodiment of a grinding lamella arranged on a plate-shaped carrier element of a grinding wheel.

FIG. 1 is a plan view of a first embodiment of a grinding lamella 1. The grinding lamella 1 is arranged on a plate-shaped carrier element 2. The carrier element 2 comprises a central through-aperture 3. The grinding lamella 1 is composed of four annular portions 4, 5, 6, 7. The four annular portions 4, 5, 6, 7 are each arranged so as to be offset relative to one another by an angle of $\alpha=60°$. All the annular portions 4, 5, 6, 7 are trapezoidal, projecting beyond the outer edge of the plate-shaped carrier element 2.

Figure 2:
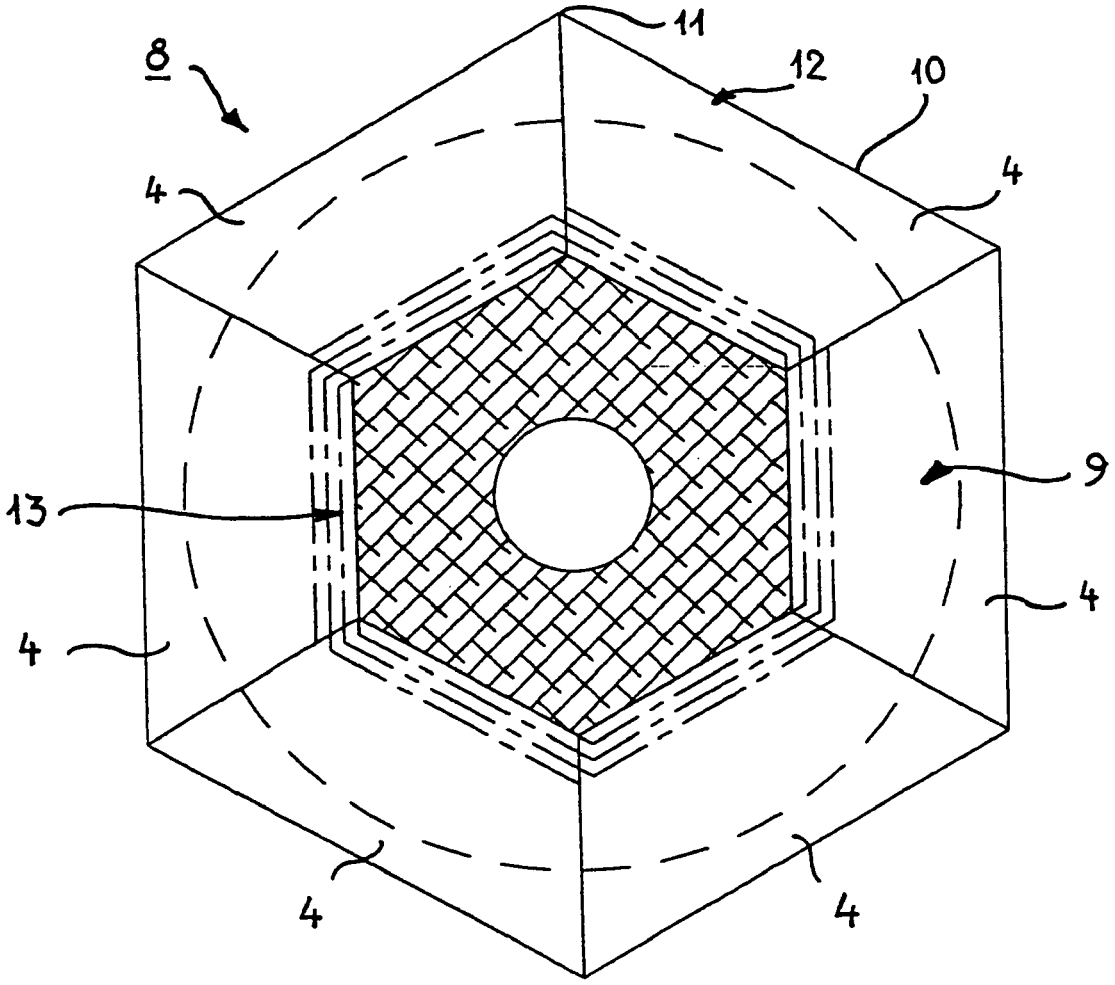
FIG. 2 is a plan view of a grinding wheel that is provided with six partially overlapping grinding lamellae according to FIG. 1.

The individual annular portions 4, 5, 6, 7 each include a different width B in the radial direction. The first annular portion 4 has the greatest width B in the radial direction R and the fourth annular portion 7 has the smallest width. The two annular portions 5 and 6 arranged between the first and fourth, each have a somewhat smaller width than the annular portion adjoining on the left. In this way, it is possible to achieve a radially directed offset of the grinding lamellae 1 arranged one above the other, as indicated in FIG. 2. The individual grinding lamellae 1 are arranged one above the other so as to be offset by an annular portion so that they overlap one another.

One annular portion 7 (each) is fixed on the carrier element, more particularly by glue. Gluing can take place in the region of the entire annular portion 7 and additionally in the region of the inner edges which face the through-aperture 3. This is possible, because, in an inner region 13, the grinding lamellae are radially offset relative to one another, so that each grinding lamella 1 in this region directly partially faces the carrier element along the entire inner edges and can be glued to same.

As can be seen in the plan view of the grinding wheel 8 according to FIG. 2, the surface of the grinding wheel only contains the annular portions 4 which each has the greatest width B in the radial direction. Furthermore, in accordance with the annular offset of the individual annular portions of $\alpha=60°$ six grinding lamellae 1 are offset relative to one another by an annular portion and form the annular shape of the grinding ring 9 of the grinding wheel 8. Because the individual annular portions 4 to 7 are identical in shape, trapezoidal with the exception of the different widths in the radial direction, a regular hexagon is obtained.

When the grinding wheel 8 rotates on a driving machine, its outer circumferential region is such that it is possible to observe the grinding result. During rotation, a semi-transparent region is formed by the straight edges 10 of the individual annular portions 4 between the corners 11. The semi-transparent region allows for monitoring of the grinding result during the grinding operation. It is only in the region of the corners 11 of the hexagonal grinding wheel 8 where the workpiece to be ground is covered. Thus, because the shape of the individual annular portions deviates in the outer circumferential region from the shape of a circular wheel with a central aperture, it is possible to achieve such a see-through region.

As can additionally be gathered from FIG. 2, the material thickness of the grinding wheel is greatest in the outer edge region 12 and continuously decreases towards the inner region 13. This is the result of different radial widths of the annular portions 4 to 7 of the grinding lamellae 1. As already mentioned, this measure allows the grinding lamellae 1 to be connected to the carrier element 2 at the inner region 13 along the entire extension of their inner edges. In addition, as a result of this measure, most of the grinding material is made available in the edge region of the grinding wheel where, during rotation, the highest speeds are achieved.

Figure 3:
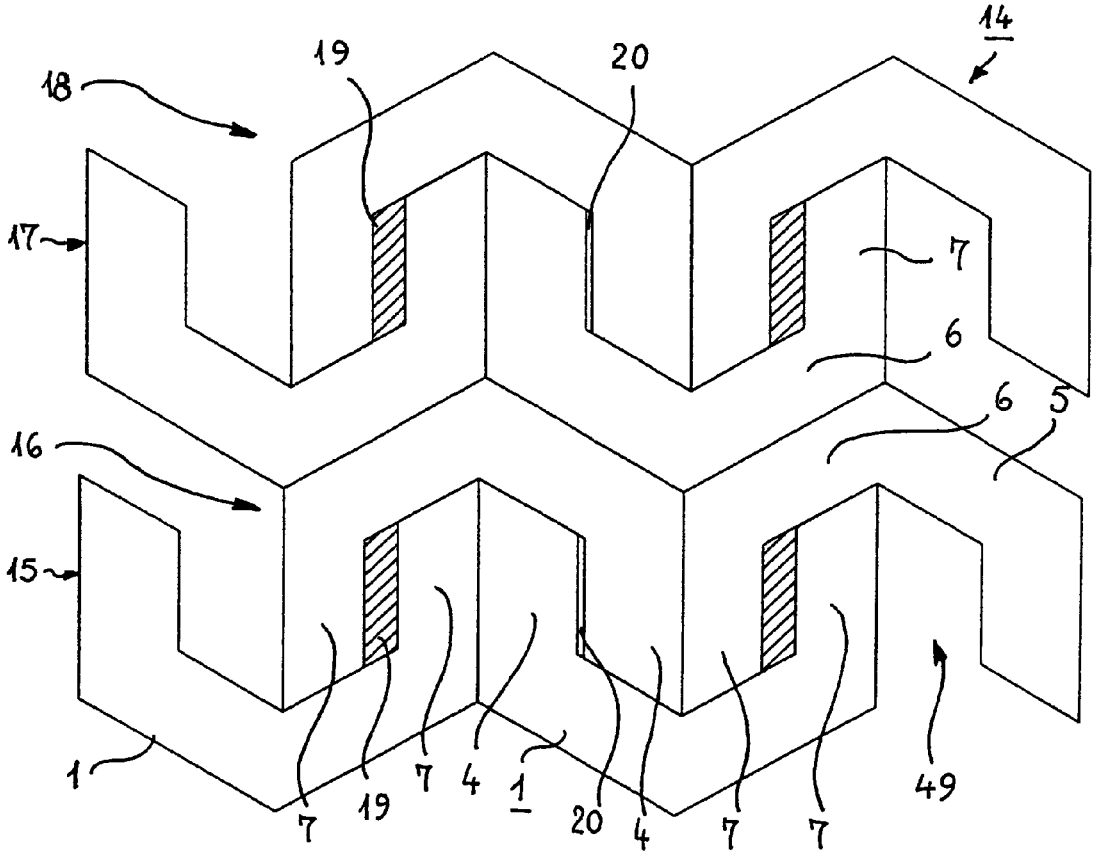
FIG. 3 is a view of a cut-out pattern for grinding lamellae according to FIG. 1.

The cut-out according to FIG. 3 shows a pattern 14 for grinding lamellae 1 according to FIG. 1. The grinding lamellae are approximately U-shaped due to the angular offset of the individual annular portions of 60°. They are arranged side by side, so that the first and the fourth annular portion 4, 7 of adjoining grinding lamellae are always arranged side by side. The first row 15 of adjoining u-shaped grinding lamellae 1 adjoins the second row 16 of u-shaped grinding lamellae which are also arranged so as to adjoin one another. However, the latter is offset by 180° relative to the first row 15. As a result, the first and fourth annular portions 4, 7 of adjoining grinding lamellae 1 engage the apertures 49 of the grinding lamellae 1 of the adjoining row. Thus, an optimum material exploitation is achieved.

A third row 17 of adjoining u-shaped grinding lamellae 1 is also offset by 180° relative to the second row 16. The central annular portions 5 and 6 are positioned to adjoin the corresponding annular portions 5 and 6 of row 16. The grinding lamellae 1 are aligned in the same direction as the grinding lamellae 1 in the first row 15. In the fourth row 18, the adjoining U-shaped grinding lamellae 1 are again rotated by 180° relative to the alignment in the third row 17. Thus, they are in the same alignment as in the second row 16. Thus, the first and the fourth annular portions 4, 7 of the grinding lamellae 1 again engage the apertures 49 of the grinding plates 1 of the adjoining row 17. With this pattern shape, the material exploitation of the grinding material used for producing grinding lamellae 1 is of an optimum nature.

For producing different radial widths of the individual annular portions 4 to 7 of the individual lamellae, regions 19, 20 are cut away between the respective annular portions 4 and 7. Thus, the different widths B of the annular portions 4 and 7 are obtained.

Figure 4:
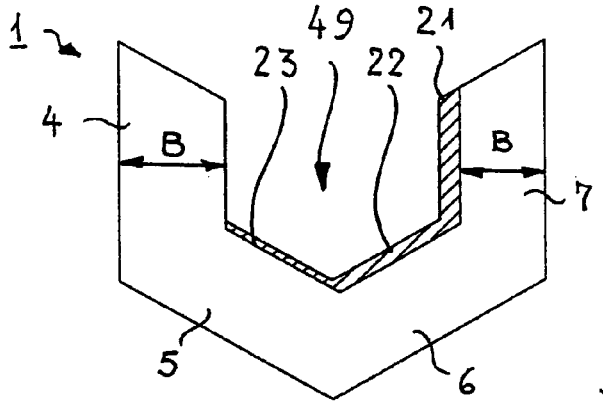
FIG. 4 is a plan view of a grinding lamella according to FIG. 1 with drawn-in cut-away regions of three annular portions.

FIG. 4 shows a detail of the grinding lamellae 1 according to FIG. 1 with additionally hatched cut-away regions 21, 22, 23 of each grinding lamella pointing towards the inner region 49 of the grinding lamellae 1. In this case, the grinding lamellae 1, according to FIG. 1, is obtained with the annular portions 4, 5, 6, 7 having different widths in the radial direction. It can be seen quite clearly that the annular portion 7 comprises the smallest width B and the annular portion 4 the greatest width B.

Figure 5:
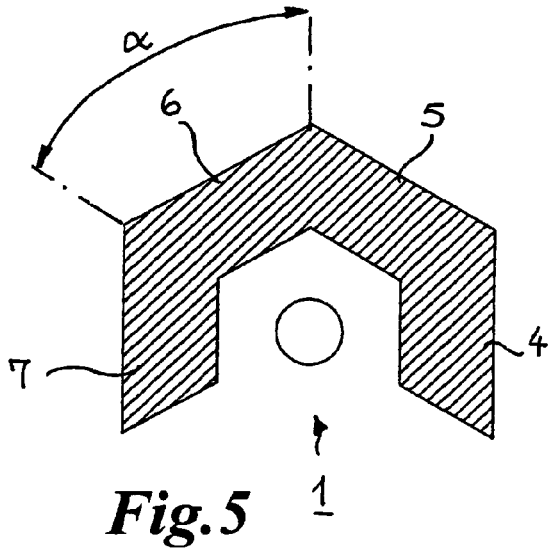
FIG. 5 is a plan view of a further embodiment of a grinding lamella.

FIG. 5 is a plan view of a modified shape of a grinding lamella 1 according to FIG. 1. The grinding lamella 1, according to FIG. 5, include annular portions 4 to 7 with the same shape and the same dimensions.

Figure 6:
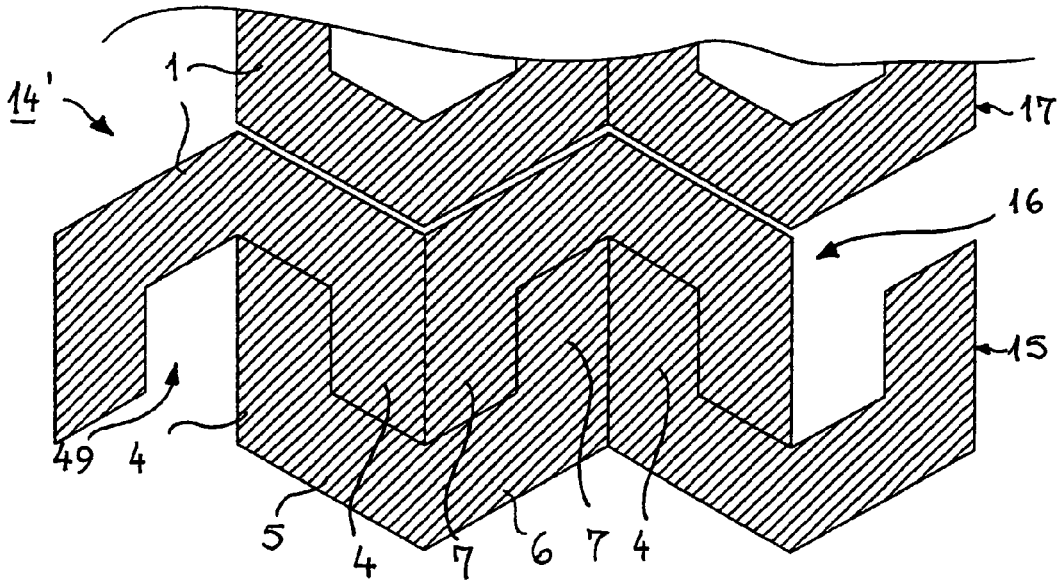
FIG. 6 is a view of a cut-out pattern for a grinding lamella according to FIG. 5.

FIG. 6 is a plan view of a detail of a pattern 14' for the grinding lamellae according to FIG. 5 that has identically formed annular portions 4, 5, 6, 7. Thus, they also have the same width in the radial direction. In principle, the design of the pattern 14' corresponds to the pattern 14 shown in FIG. 3. Because all the annular portions 4, 5, 6, 7 have the same shape and dimensions, the wastage when using pattern 14' is even less than that of pattern 14 according to FIG. 3.

Figure 7:
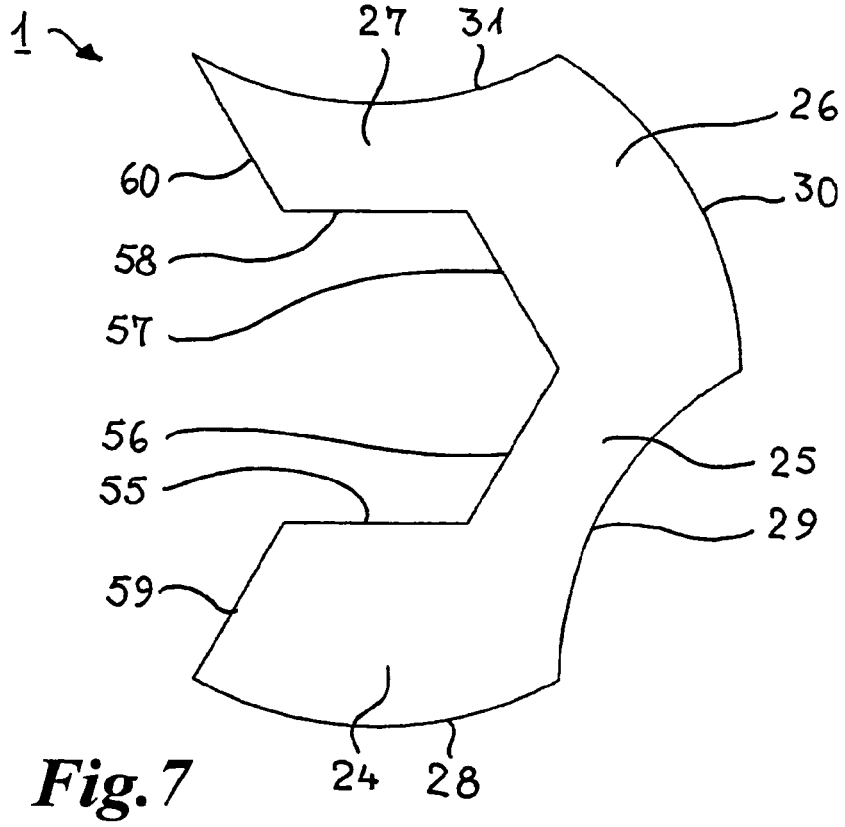
FIG. 7 is a plan view of a further embodiment of a grinding lamella with concave and convex outer circumferential edges on the annular portions.
Figure 8:
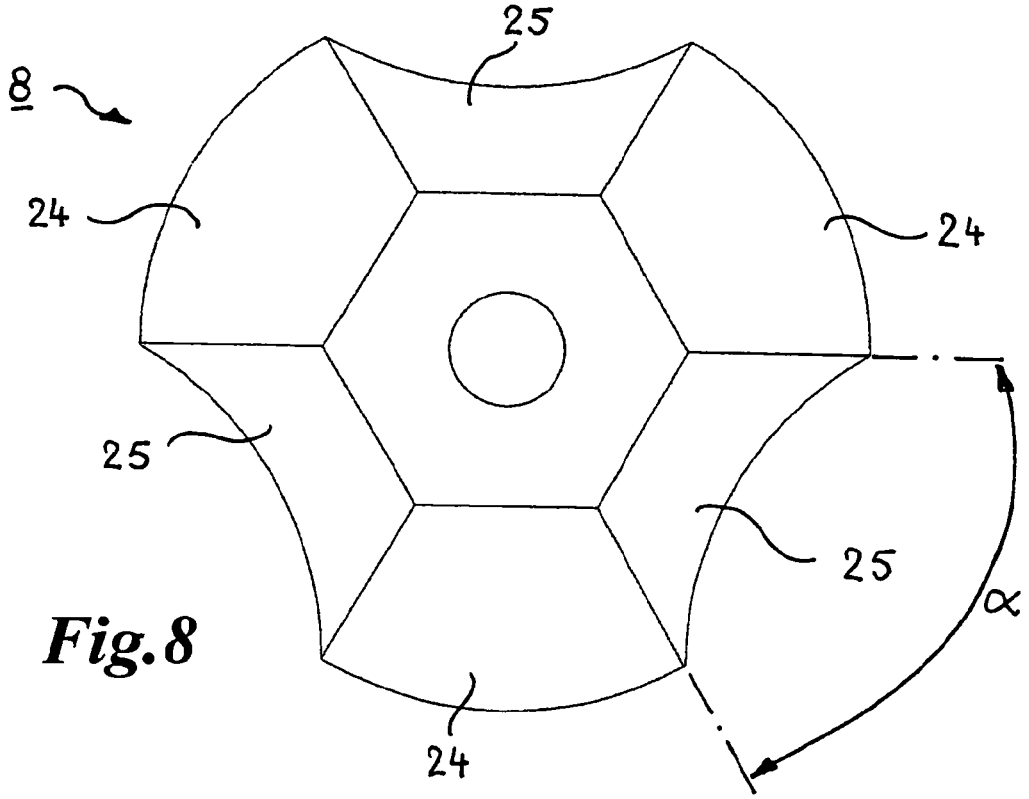
FIG. 8 is a plan view of a grinding wheel composed of three or six offset, partially overlapping grinding lamellae according to FIG. 7.

FIG. 7 shows a further embodiment of a grinding lamella 1. Instead of straight edges 10 at the annular portion 24, it comprises a convex edge 28. However, the annular portion 25 arranged to adjoin the annular portion 24 has a concave edge 29. The annular portion 26 adjoining the annular portion 25 again has a convex edge 30 and the annular portion 27 adjoining the annular portion 26 has a concave edge 31. As a result, as shown in FIG. 8 in plan view, it is possible to provide a see-through region in the region of the concave edges 29, 31 when the resulting grinding wheel rotates. The convex edges 28, 30, do not form such a see-through region because they determine the outer circumference of the grinding wheel 8, at least if they extend in the radial direction.

As, again, the individual annular portions 24 to 27 are offset relative to one another by an angle $\alpha$ of 60°. It is preferable to arrange three identical overlapping grinding lamellae. The grinding lamellae 1 are offset relative to one another by two annular portions. It is also possible to provide six grinding lamellae 1, with three of the six grinding lamellae 1 being identical relative to one another and with the remaining three of the six grinding lamellae 1 being designed so as to be mirror-symmetrical relative to the first three grinding lamellae 1. In this case, the grinding lamellae 1 are offset relative to one another by one annular portion.

In principle it is possible to arrange a number of grinding lamellae which differs from the number three or six which are offset relative to one another and are arranged one above the other. It makes sense to provide as many grinding lamellae as there are individual annular portions distributed side by side around the circumference of the grinding wheel in order to be able to provide each portion of the grinding wheel with the same number of layers of grinding lamellae. If, for example, the annular portions of the grinding lamellae comprise an angular offset of $\alpha$=30°, it is an optimum solution to provide twelve grinding lamellae so as to be offset and arranged above one another. However, in principle it is also possible to provide a smaller number of grinding lamellae, a number which is smaller than the number of annular portions forming a grinding wheel, as shown in FIG. 8. However, this could lead to there being more wear in some regions than in others. Thus, the service life of the grinding wheel is not as optimum as in those cases where the grinding lamellae are uniformly distributed around the circumference of the grinding wheel.

Figure 9:
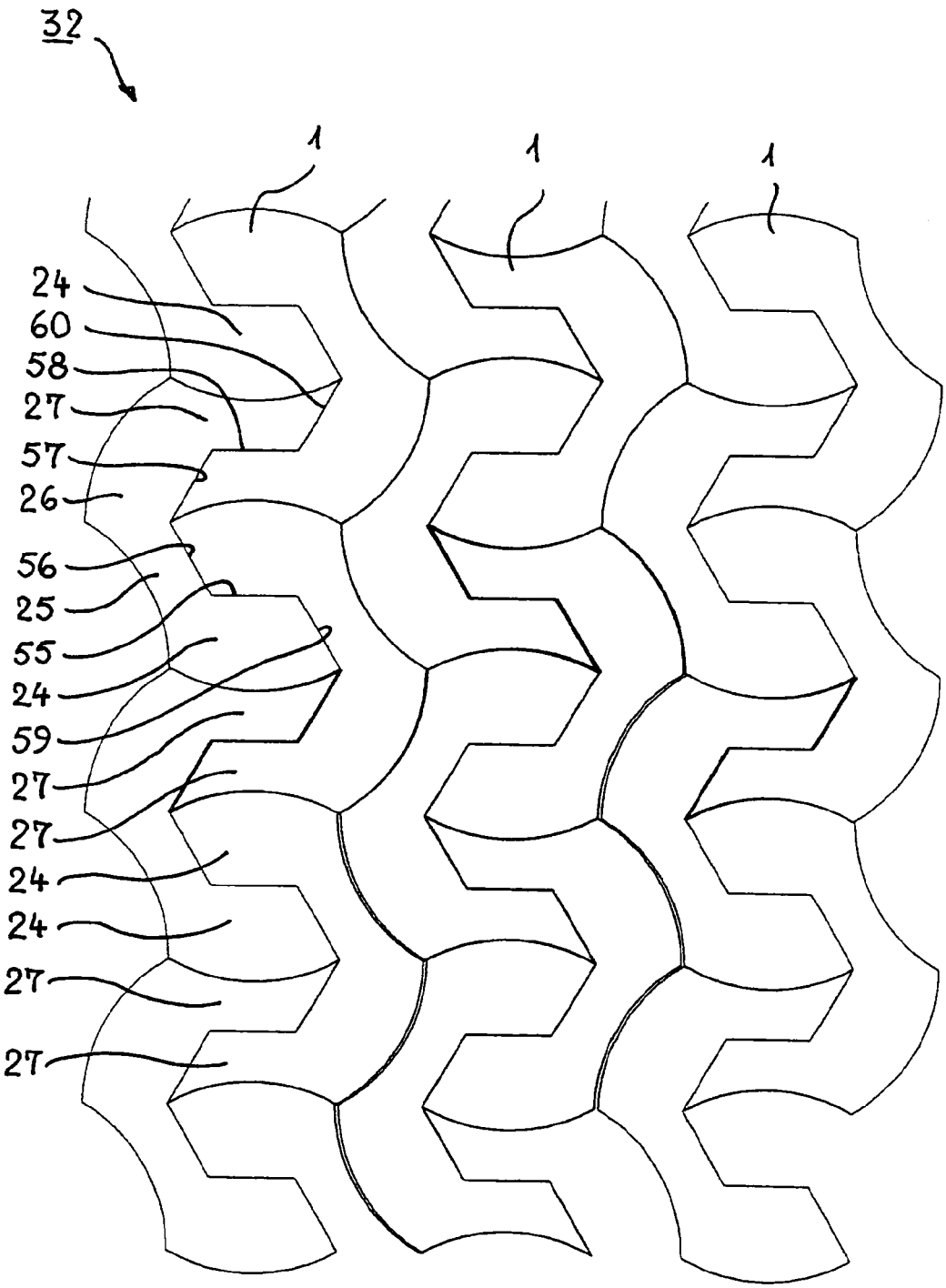
FIG. 9 is a view of a cut-out pattern for the grinding lamella according to FIG. 7, showing six rows of grinding lamellae arranged side by side.

FIG. 9 is a plan view of a pattern 32 for producing grinding lamellae 1 according to FIG. 7. It can be seen that each two of inter-engaging grinding lamellae 1 comprise identical grinding lamellae 1. The grinding lamellae 1 of the first two rows on the left are mirror-symmetrical relative to the grinding lamellae 1 of the two adjoining rows. In principle, the patterns corresponds to those in FIGS. 3 and 6. The respective convex and concave edges of the annular portions 25 and 26 engage one another, just like the convex and concave edges 28, 31. The straight inner edges 55 to 58 delimit the respective inner region 49 of the grinding lamellae 1 and the end straight edges 59, 60 of the annular portions 24 and 27. In this shape, too, it is possible to achieve optimum utilisation of the grinding material for producing grinding lamellae 1 substantially without any waste.

FIGS. 10 to 13 show a further embodiment of a grinding lamellae 1. At its respective annular portion 34, 35, 36, 37, it has an outer edge 33 that is convex as well as concave. The shape of the annular portions 34 to 37 in the region of the outer edge 33 is the same in all annular portions. The annular portion 34 additionally has an inner edge 38 that is convex and concave. It rests on the upper side of the carrier element 2 after the grinding lamellae 1 have been arranged so as to overlap, as can be gathered from FIG. 12.

Figure 10:
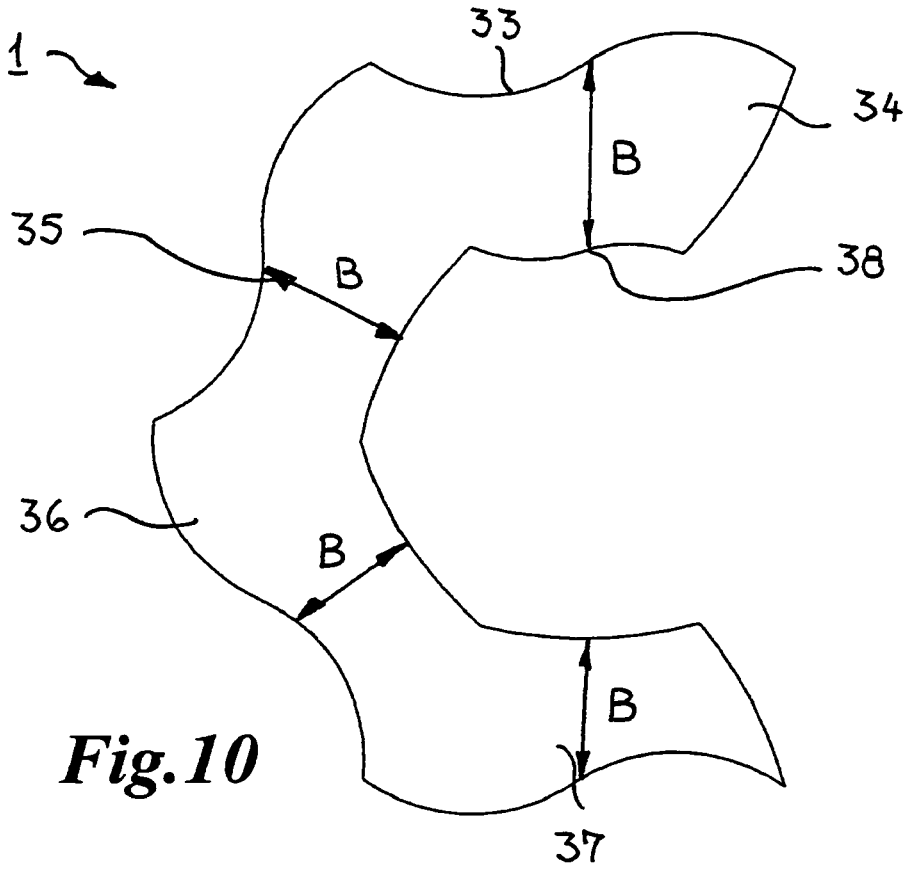
FIG. 10 shows a detail of a further embodiment of a grinding lamella.
Figure 12:
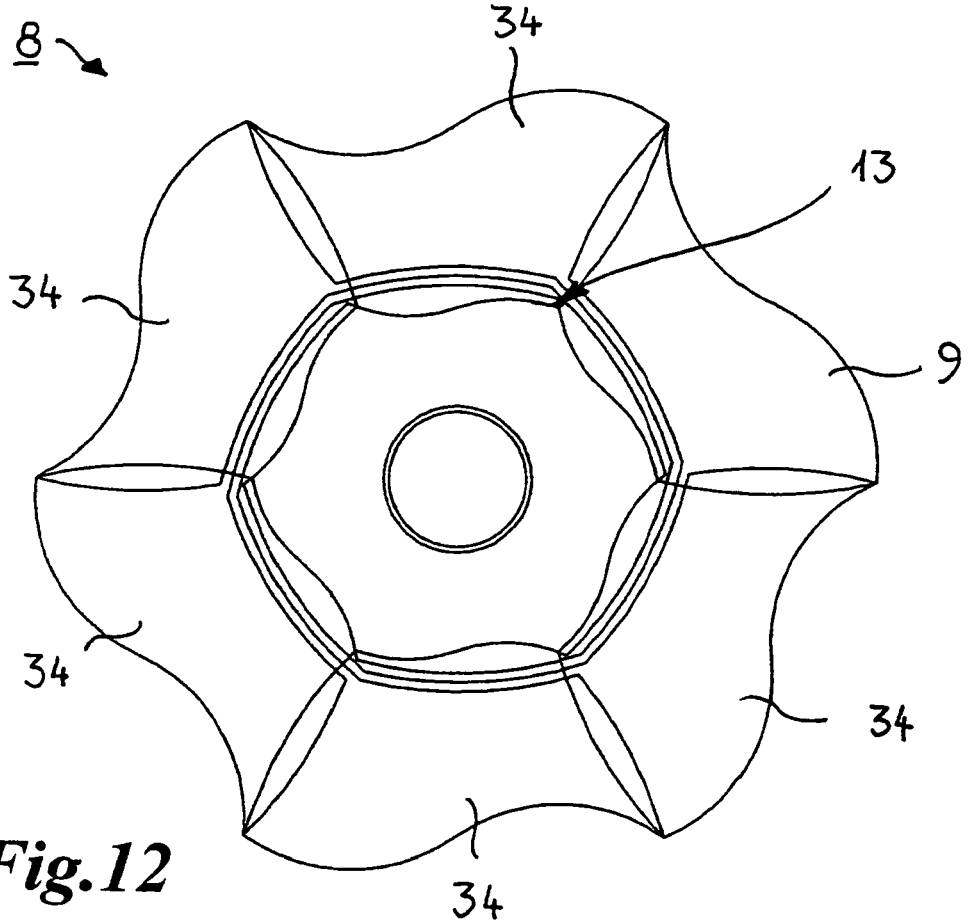
FIG. 12 is a plan view of a grinding wheel produced from grinding lamellae according to FIG. 10.

The width B of the annular portions 34 in the radial direction is again greater than that of the remaining annular portions. This makes it possible for a thinner layer of material to be achieved towards the inner region 13 of the grinding wheel than in the outer edge region, thus permitting the grinding plates 1 to be glued in the inner region along all the inner edges. The annular portions 35 to 37, too, each include a smaller width B in the radial direction than the nearest annular portion on the right, as indicated in FIG. 10. The resulting staggered effect in the inner region of the grinding wheel is indicated in FIG. 12.

Figure 11:
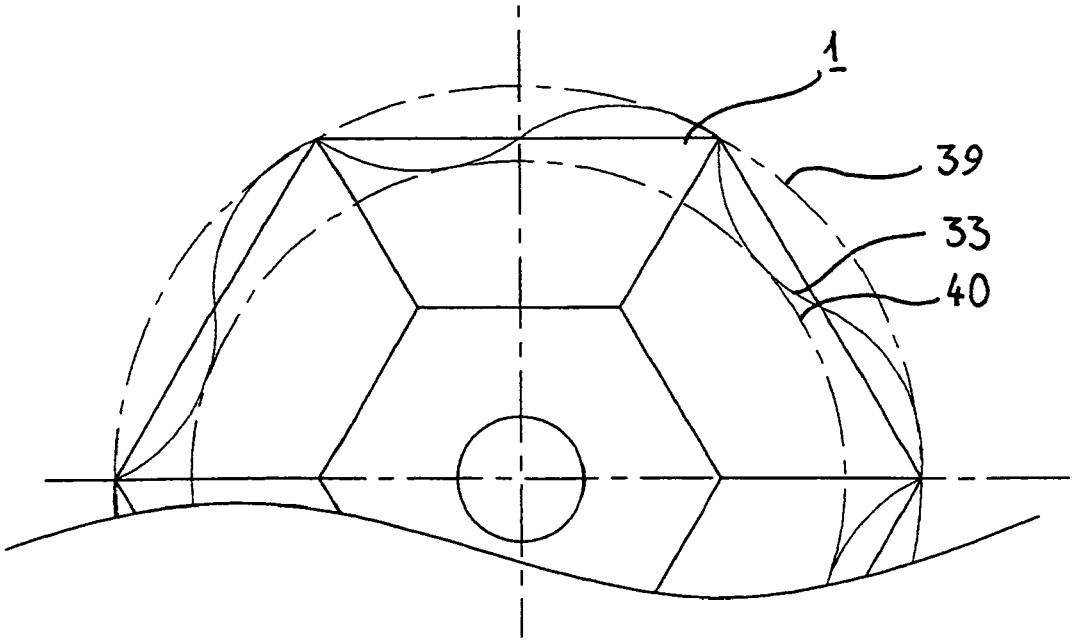
FIG. 11 is a sketch of a detail of the shape of the concave and convex outer circumferential edge of the grinding wheel with grinding lamellae according to FIG. 10, for comparative purposes drawn on to the grinding wheel according to FIG. 2.

As can be gathered from FIG. 11, the convex and concave shape of the outer edges 33 of the individual annular portions is sinusoidal. However, it is also possible to select any other shape that creates a partial region whose shape deviates from that of a circular wheel, as indicated by the dashed line 39 in FIG. 11 in order to allow visual monitoring of the workpiece to be ground. In this embodiment, the sinusoidal shape of the outer edge 33 of the annular portions extends between the outer dashed circle 39 and the inner dashed circle 40.

Figure 13:
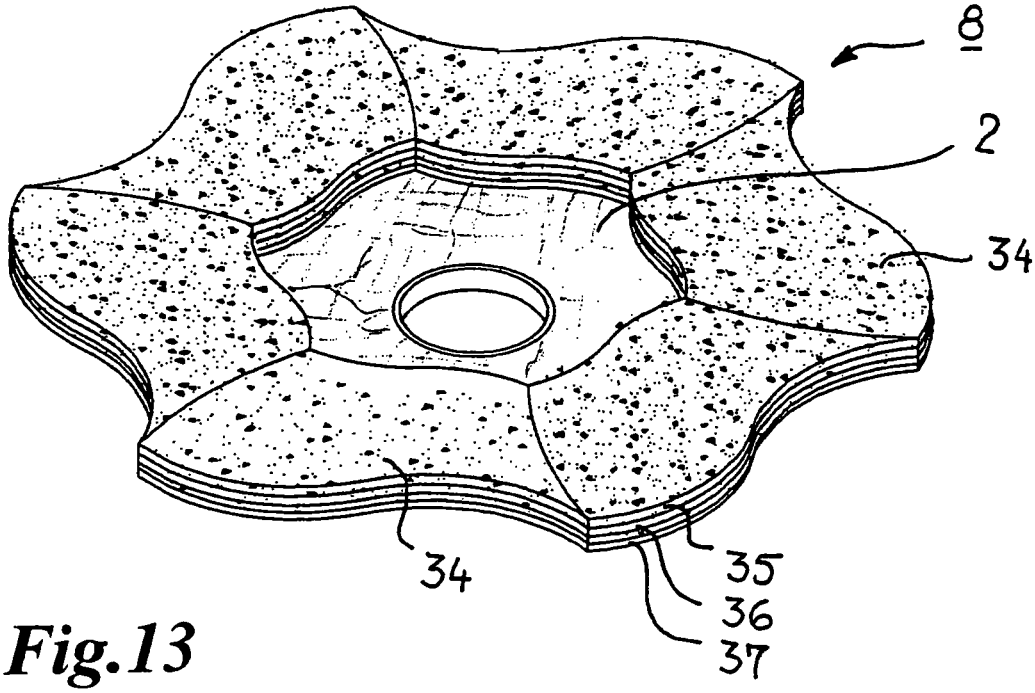
FIG. 13 is a perspective view of the grinding wheel according to FIG. 12.

As can be seen in the perspective view in FIG. 13, the grinding wheel 8 is multi-layered in the outer edge region. There are six grinding lamellae each having four annular portions 34 to 37 that are arranged at an angle of $\alpha$=60° relative to one another. The six are arranged one above the other and are offset relative to one another. Thus, a multi-layered grinding wheel 8 is obtained that ensures a long service life.

The carrier element 2 visible in the inner region 13 of the grinding wheel 8 can either be provided in the form of a plate consisting of metal or in the form of a wheel with a central through-aperture 3. Additionally, it may be formed of a plurality of layers of grinding material or of a reinforced layer of grinding material, as shown in the plan view of the grinding wheel 8. If a plate-shaped carrier element 2 is provided, it can include a diameter, for example, as indicated by the circle 40 shown in dashed line in FIG. 11. In principle, it advantageously includes a smaller diameter than the circle 40 shown in dashed lines, which connects the innermost extensions of the outer edges 33 of the annular portions to one another in order to avoid unintended damage to the workpiece to be machined as a result of contact with the hard carrier material.

Figure 14:
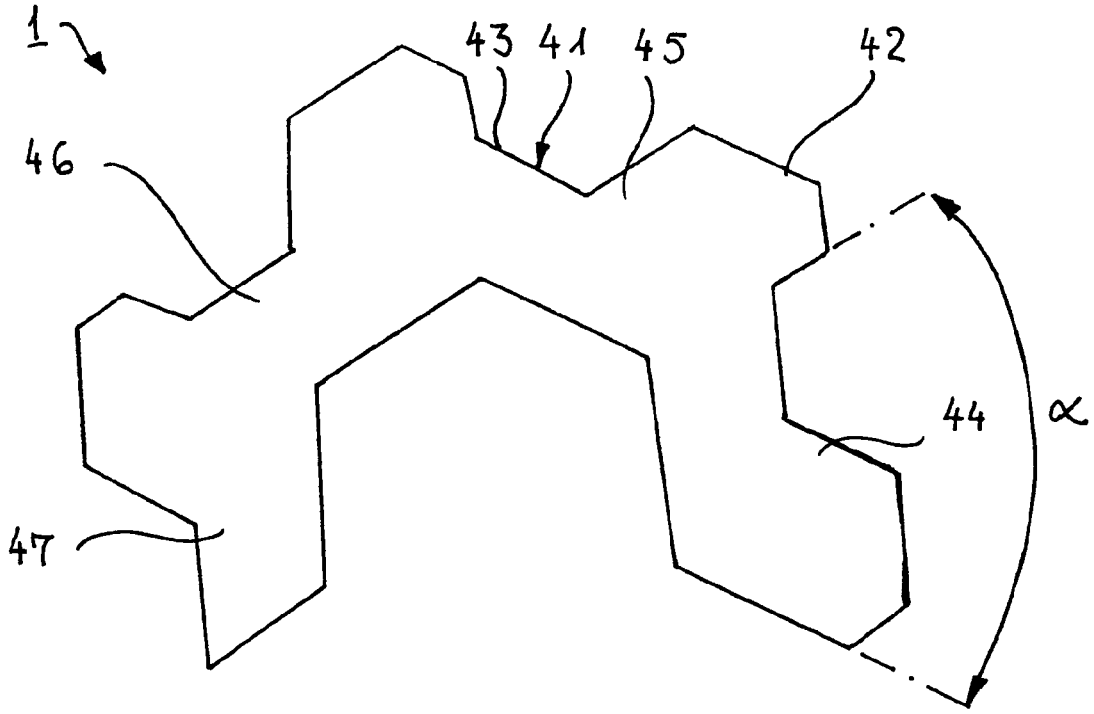
FIG. 14 is a plan view of a further alternative embodiment of a grinding lamella with portions projecting forwards and backwards along the outer circumferential edge of the annular portions of the grinding lamella.

FIG. 14 shows a plan view of a further embodiment of a grinding lamellae 1 with annular portions 44 to 47. Instead of having an outer edge with concave and convex portions, it includes an outer edge 41 with a portion 42 projecting forwards and a portion 43 projecting backwards. This shape is the same for all annular portions 44 to 47. Accordingly, a visual monitoring of the grinding progress is provided in the region of the portions 43 projecting backwards. They form a semi-transparent strip-shaped region when the grinding wheel rotates. As in this case, too, four annular portions 44 to 47 are provided that are offset relative to one another by an angle of $\alpha=60°$. Preferably, six such grinding lamellae are arranged one above the other and offset by an annular portion, and connected to the carrier element.

In addition to the embodiments of grinding lamellae, grinding wheels and patterns for producing such grinding lamellae as described above and illustrated in the drawings. It is possible to provide a large number of further embodiments wherein the grinding lamellae each comprise at least two annular portions arranged at an angle relative to one another. If these, in addition, include a shape that deviates at least partially from that of a circular wheel with a central aperture, it is possible to achieve in the outer region a see-through region for monitoring the grinding progress of a workpiece to be machined. Alternatively or additionally, it is also possible to provide apertures within the annular portions to achieve such visual monitoring. In principle, it is also possible—if there is no need for visually monitoring the grinding progress—to provide grinding lamellae in the form of annular portions that are arranged so as to overlap, with the annular portions forming an annular shape that corresponds to that of an annular wheel with a central aperture. In this embodiment, too, it is possible to provide the annular portions in the radial direction with a width that varies from portion to portion in order to achieve radial staggering of the annular portions of the grinding lamellae, which annular portions are positioned one above the other.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A grinding lamella for a rotatingly drivable grinding wheel comprising:

at least two annular portions arranged end to end at an angle relative to one another such that the annular portions together form a sector of a ring and at least partially comprise a shape that deviates from the shape of a circular wheel with a central aperture.

2. The grinding lamella according to claim 1, wherein the grinding lamella comprises four annular portions offset relative to one another.

3. The grinding lamella according to claim 2, wherein the annular portions have approximately the same shape.

4. The grinding lamella according to claim 2, wherein at least one of the annular portions has a shape that deviates from that of the remaining annular portions.

5. The grinding lamella according to claim 4, wherein the annular portions, relative to one another, in a direction from a radially extending central axis, have a different width in a radial direction of the grinding lamella.

6. The grinding lamella according to claim 5, wherein a first annular portion comprises the greatest width and a last annular portion, the smallest width in the radial direction of the grinding lamella.

7. The grinding lamella according to claim 5, wherein a transition from one annular portion to an adjoining annular portion is provided with a step.

8. The grinding lamella according to claim 7, wherein an transition from the annular portion with the greatest width in the radial direction towards the adjoining annular portion is provided with a step.

9. The grinding lamella according to claim 1, wherein an outer circumferential edge of at least one annular portion is curved so as to be concave or convex.

10. A grinding wheel with at least one carrier element and with at least two grinding lamellae according to claim 1, wherein said grinding lamellae partially overlap one another and, together, form an annular shape.

11. The grinding wheel according to claim 10, wherein six grinding lamellae, while partially overlapping, are stacked and offset relative to one another by one annular portion.

12. The grinding wheel according to claim 10, wherein, in a radial direction, the partially overlapping grinding lamellae are of different widths and that, in an inner region of the grinding wheel, the annular portions, in a radial direction, are stacked in a step-like manner.

13. The grinding wheel according to claim 12, wherein, along their inner edges, the at least two grinding lamellae are connected, more particularly glued, to the at least one carrier element.

14. The grinding wheel according to claim 10, wherein, in a plan view, the grinding wheel is polygonal.

15. The grinding wheel according to claim 10, wherein, in a plan view, the grinding wheel comprises at least one rounded portion.

16. The grinding wheel according to claim 15, wherein, along the grinding wheel outer circumferential edge, the grinding wheel comprises a concavely and a convexly rounded annular portion.

17. The grinding wheel according to claim 10, wherein, along the grinding wheel outer circumferential edge, the grinding wheel comprises at least one cut-out or one recess.

18. The grinding wheel according to claim 10, wherein the carrier element is plate-shaped.

19. The grinding wheel according to claim 18, wherein the plate-shaped carrier element consists of a metal, a resin-bonded glass fiber texture, a fiber material or a plastic material, preferably vulcanised fiber.

20. A piece of cut material or a strip of material for producing grinding lamellae according to claim 1, wherein the grinding lamellae are connected to one another and arranged in rows next to one another in the same direction wherein two adjoining rows are offset relative to one another by 180° and arranged so as to connect with one another.

21. A piece of cut material or strip of material according to claim 20, wherein the grinding lamellae are approximately U-shaped with four annular portions arranged at an angle relative to one another, and that they are arranged in such a way that the first and the fourth annular portions and the second and third annular portions are arranged so as to connect with one another.

22. The piece of cut material or strip of material according to claim 21, wherein the first and the fourth annular portions of one row of grinding lamellae engage apertures between first and fourth annular portions of the grinding lamellae of an adjoining row.

23. A grinding lamella for a rotatingly drivable grinding wheel comprising:

at least two annular portions arranged end to end at an angle relative to one another such that the annular portions together form a section of a ring and at least partially comprise a shape that deviates from the shape of a circular wheel with a central aperture, the annular portions having inner and outer edges, the inner edges are adapted for attaching to the grinding wheel and the outer edges ared adapted to define a peripheral boundary when the inner edges are attached to the grinding wheel.

* * * * *

UNITED STATES PATENT AND TRADEMARK OFFICE

CERTIFICATE OF CORRECTION

PATENT NO. : 8,360,830 B2
APPLICATION NO. : 12/224703
DATED : January 29, 2013
INVENTOR(S) : Georg Klug It is certified that error appears in the above-identified patent and that said Letters Patent is hereby corrected as shown below:

In the Claims:

Column 12,
Line 10, Claim 23, "ared" should be --are--

Signed and Sealed this
Fourth Day of June, 2013

Teresa Stanek Rea
*Acting Director of the United States Patent and Trademark Office*